US006840602B2

(12) United States Patent
Watanabe et al.

(10) Patent No.: US 6,840,602 B2
(45) Date of Patent: Jan. 11, 2005

(54) INKJET HEAD FOR INKJET PRINTING APPARATUS

(75) Inventors: Hidetoshi Watanabe, Aichi-ken (JP); Atsuo Sakaida, Gifu-ken (JP); Atsushi Hirota, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/305,955

(22) Filed: Nov. 29, 2002

(65) Prior Publication Data

US 2003/0103115 A1 Jun. 5, 2003

(30) Foreign Application Priority Data

Nov. 30, 2001 (JP) ..... 2001-365723

(51) Int. Cl.[7] ..... B41J 2/045
(52) U.S. Cl. ..... 347/71
(58) Field of Search ..... 347/68, 70–72

(56) References Cited

U.S. PATENT DOCUMENTS 4,578,686 A 3/1986 Vollert
5,402,159 A 3/1995 Takahashi et al.
5,856,837 A 1/1999 Kitahara et al.
5,933,167 A 8/1999 Shimada et al.
6,488,355 B2 * 12/2002 Nakamura et al. ..... 347/40

FOREIGN PATENT DOCUMENTS

EP 0 698 490 A2 2/1996
EP 1 138 493 A1 10/2001
JP A 4-341852 11/1992

* cited by examiner

*Primary Examiner*—Michael S. Brooke
(74) *Attorney, Agent, or Firm*—Oliff & Berridge, PLC

(57) ABSTRACT

An inkjet head has a plurality of pressure chambers. An end of each pressure chamber is connected to a discharging nozzle and the other end to an ink supplier. The pressure chamber has a rhombic shape having longer and shorter diagonals. The inkjet head further includes an actuator unit, which has at least one planar piezoelectric layer covering over the plurality of pressure chambers, a common electrode provided on one side surface of one of the at least one planar piezoelectric layer, and a plurality of driving electrodes provided for the pressure chambers, respectively. The plurality of driving electrodes are formed on the other side of the one of the at least one planar piezoelectric layer. Further, conditions: $0.1\ \text{mm} \leqq L$ and $0.29 \leqq \delta/\lambda \leqq 1$ are satisfied, where L represents the length of the shorter diagonal and δ represents a length of a driving electrode extending in parallel with the width L.

22 Claims, 14 Drawing Sheets

| | THE NUMBER OF LAYERS | | | THICKNESS OF LAYERS [μm] | WIDTH OF DRIVING ELECTRODE [μm] | ELECTRICAL EFFICIENCY [pl/nF] | AREA EFFICIENCY [pl/mm²] | DEFORMATION EFFICIENCY [pl²(nF•mm²)] |
|---|---|---|---|---|---|---|---|---|
| | TOTAL | ACTIVE LAYER | INACTIVE LAYER | | | | | |
| CMP EX. | 10 | | | | | 7.143 | 10.204 | 72.886 |
| CONCRETE EXAMPLE 1 | 4 | 2 | 2 | 10 | 100 | 9.259 | 17.793 | 164.742 |
| | | | | | 150 | 13.600 | 39.204 | 533.191 |
| | | | | | 200 | 14.758 | 56.722 | 837.108 |
| | | | | | 250 | 12.034 | 57.816 | 695.764 |
| | | | | | 300 | 9.995 | 57.621 | 575.899 |
| | | | | | 350 | 4.499 | 30.256 | 136.122 |
| CONCRETE EXAMPLE 2 | 4 | 2 | 2 | 15 | 100 | 8.965 | 11.486 | 102.973 |
| | | | | | 150 | 11.991 | 23.044 | 276.324 |
| | | | | | 200 | 13.000 | 33.311 | 433.051 |
| | | | | | 250 | 11.260 | 36.064 | 406.085 |
| | | | | | 300 | 9.971 | 38.324 | 382.149 |
| | | | | | 350 | 6.325 | 28.363 | 179.411 |
| CONCRETE EXAMPLE 3 | 5 | 2 | 3 | 10 | 100 | 11.209 | 21.540 | 241.437 |
| | | | | | 150 | 13.690 | 39.463 | 540.264 |
| | | | | | 200 | 12.842 | 49.356 | 633.818 |
| | | | | | 250 | 10.905 | 52.392 | 571.352 |
| | | | | | 300 | 9.287 | 53.539 | 497.197 |
| | | | | | 350 | 5.133 | 34.524 | 177.210 |
| CONCRETE EXAMPLE 4 | 5 | 2 | 3 | 15 | 100 | 9.063 | 11.611 | 105.226 |
| | | | | | 150 | 11.025 | 21.187 | 233.583 |
| | | | | | 200 | 10.603 | 27.168 | 288.058 |
| | | | | | 300 | 8.526 | 32.770 | 279.413 |
| | | | | | 350 | 5.879 | 26.360 | 154.957 |
| CONCRETE EXAMPLE 5 | 6 | 2 | 4 | 10 | 100 | 10.016 | 19.248 | 192.781 |
| | | | | | 150 | 12.112 | 34.914 | 422.887 |
| | | | | | 200 | 11.403 | 43.828 | 499.787 |
| | | | | | 250 | 10.177 | 48.891 | 497.541 |
| | | | | | 300 | 8.120 | 46.814 | 380.145 |
| | | | | | 350 | 4.980 | 33.495 | 166.806 |
| CONCRETE EXAMPLE 6 | 6 | 3 | 3 | 10 | 100 | 7.929 | 22.855 | 181.206 |
| | | | | | 150 | 9.761 | 42.204 | 411.950 |
| | | | | | 200 | 9.668 | 55.737 | 538.863 |
| | | | | | 250 | 8.824 | 63.587 | 561.065 |
| | | | | | 300 | 7.678 | 66.396 | 509.777 |
| | | | | | 350 | 5.093 | 51.383 | 261.691 |

FIG. 7

INKJET HEAD FOR INKJET PRINTING APPARATUS

BACKGROUND OF THE INVENTION

The present invention relates to an inkjet head for an inkjet printing apparatus, and more particularly to a structure of an inkjet head.

Recently, inkjet printing apparatuses are widely used. An inkjet head (i.e., a printing head) employed in an inkjet printing apparatus is configured such that ink is supplied from an ink tank into manifolds and distributed to a plurality of pressure chambers defined in the inkjet head. By selectively applying pressure to the pressure chambers, ink is selectively ejected through the nozzles, which are defined corresponding to the pressure chambers, respectively. For selectively applying pressure to respective pressure chambers, an actuator unit composed of laminated sheets of piezoelectric ceramic is widely used.

An example of such an inkjet head is disclosed in U.S. Pat. No. 5,402,159, teachings of which are incorporated herein by reference. The above-described patent discloses an inkjet head which includes a piezoelectric actuator unit having laminated layers extending over a plurality of pressure chambers.

In the inkjet head of this type, it is desired that the pressure chambers are made smaller so that the plurality of the pressure chambers are arranged at the high density.

Further, in the inkjet head of the above type, electrodes (a common electrode and a driving electrode) are provided for each pressure chamber to sandwich one of more layers at a portion corresponding to each pressure chamber. By applying certain voltage to the electrodes, the piezoelectric layer (s) sandwiched between the electrodes deforms so that a pressure is applied to the ink in each pressure chamber. If the voltage potential difference between the common electrode and the driving electrode is made smaller, a driver for driving the piezoelectric actuator can be downsized, which may decrease the manufacturing cost of the inkjet head.

When downsizing of the inkjet head is considered, it should be noted that, if the pressure chambers are made too small and/or if the voltage potential difference described above is set too small, variation of the capacity of the pressure chambers may become insufficient and the sufficient amount of ink may not be ejected.

SUMMARY OF THE INVENTION

The present invention is advantageous in that an improved inkjet head is provided, in which the voltage potential difference between the common electrode and driving electrode is relatively small with maintaining a sufficient variation of the capacity of each pressure chamber.

According to an aspect of the invention, there is provided an inkjet head, which is provided with a plurality of pressure chambers, each of which being configured such that an end thereof is connected to a discharging nozzle and the other and is connected to an ink supplier, each of the pressure chamber having a shape defined by a longitudinal length and a width which is not longer than the longitudinal length, and an actuator unit for the plurality of pressure chambers. In the inkjet head above, the actuator unit includes at least one planar piezoelectric layer covering over the plurality of pressure chambers, a planar common electrode provided on one side surface of the at least one planar piezoelectric layers, and a plurality of planar driving electrodes provided for the pressure chambers, respectively. The plurality of driving electrodes are formed on the other side of the at least one planar piezoelectric layer.

Further, according to an embodiment, conditions:

$$0.1\ \text{mm} \leqq L, \text{ and}$$

$$0.29 \leqq \delta/\lambda \leqq 1,$$

are satisfied, wherein L represents the width of a pressure chamber and $\delta$ represents a length of a driving electrode extending in parallel with the width L.

Optionally, the at least one planar piezoelectric layer may include an active layer sandwiched between the common electrode and the plurality of driving electrodes, and inactive layer which is not sandwiched by the common electrode and driving electrodes. When each of the plurality of driving electrodes is set to have a voltage different from the potential of the common electrode, a portion of the active layer corresponding to the driving electrode deforms in accordance with piezoelectric transverse effect, a unimorph effect being generated by the deformation of the active layer in association with the inactive layer to vary a capacity of each pressure chamber.

Further optionally, central position of the driving electrode substantially coincides with the central position of the width of the pressure chamber.

Further to the condition described above, the inkjet head may be configured to satisfy condition:

$$0.15\ \text{mm} \leqq L \leqq 0.8\ \text{mm}.$$

Optionally, condition:

$$0.4 \leqq \delta/L \leqq 0.94$$

may be satisfied.

In a particular case, condition:

$$0.49 \leqq \delta/L \leqq 0.86$$

may be satisfied.

Further optionally, condition:

$$0.57 \leqq \delta/L \leqq 0.77$$

may be satisfied.

According to an embodiment, the shape of the driving electrode is similar to a projected shape of the pressure chamber on the piezoelectric layers.

Optionally, each of the pressure chambers has a rhombic shape, and the width of the pressure chamber is represented by a direction of a shorter diagonal of the rhombic shape.

Further optionally, the actuator may include at least a plurality of active layers, or a plurality of inactive layers.

According to another aspect of the invention, there is provided an inkjet head, which is provided with a plurality of pressure chambers, each of which being configured such that an end thereof is connected to a discharging nozzle and the other end is connected to an ink supplier, each of the pressure chamber having a rhombic shape having a longer diagonal and a shorter diagonal, and an actuator unit for the plurality of pressure chambers. The actuator unit includes at least one planar piezoelectric layer covering over the plurality of pressure chambers, a planar common electrode provided on one side surface of the at least one planar piezoelectric layer, and a plurality of planar driving electrodes provided for the pressure chambers, respectively. The plurality of driving electrodes are formed on the other side of the at least one planar piezoelectric layer, and conditions:

$0.1\ \text{mm} \leq L$, and $0.29 \leq \delta/\lambda \leq 1$, are satisfied, wherein L represents a length of the shorter diagonal of each pressure chamber and δ represents a length of a driving electrode extending in parallel with the length L.

Still optionally, a shape of each driving electrode may be included within an area that is a projection of a pressure chamber on the actuator.

BRIEF DESCRIPTION OF THE ACCOMPANYING DRAWINGS

FIG. 7 shows a table indicating simulation results for concrete examples and comparative example.

DETAILED DESCRIPTION OF THE EMBODIMENT

Hereinafter, embodiments of the invention will be described with reference to the accompanying drawings.

Figure 1:
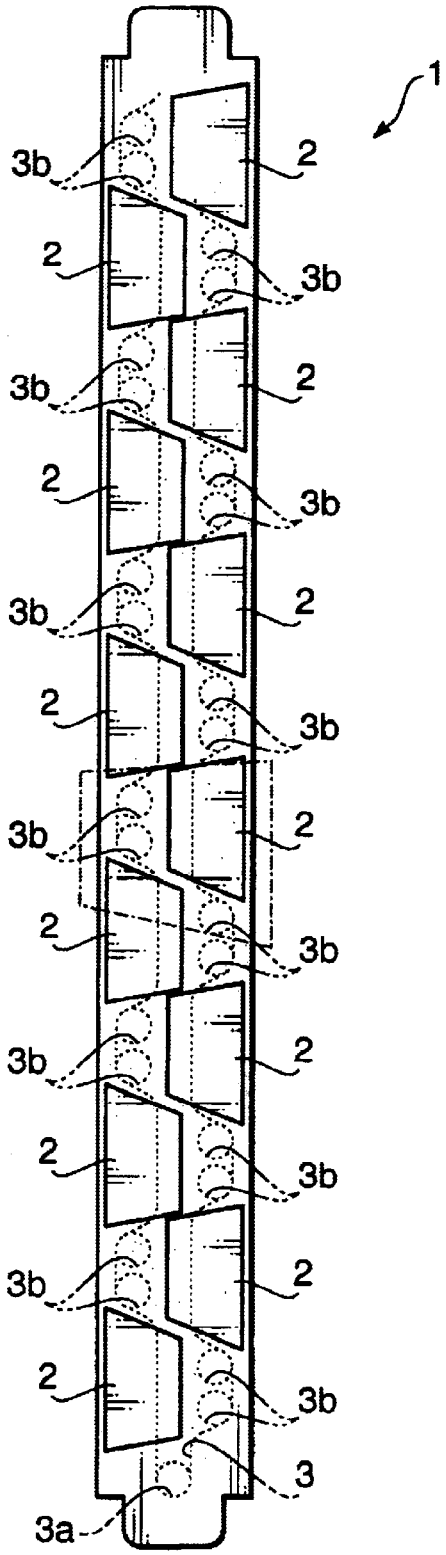
FIG. 1 is a bottom view of an inkjet head according to an embodiment of the invention.
Figure 2:
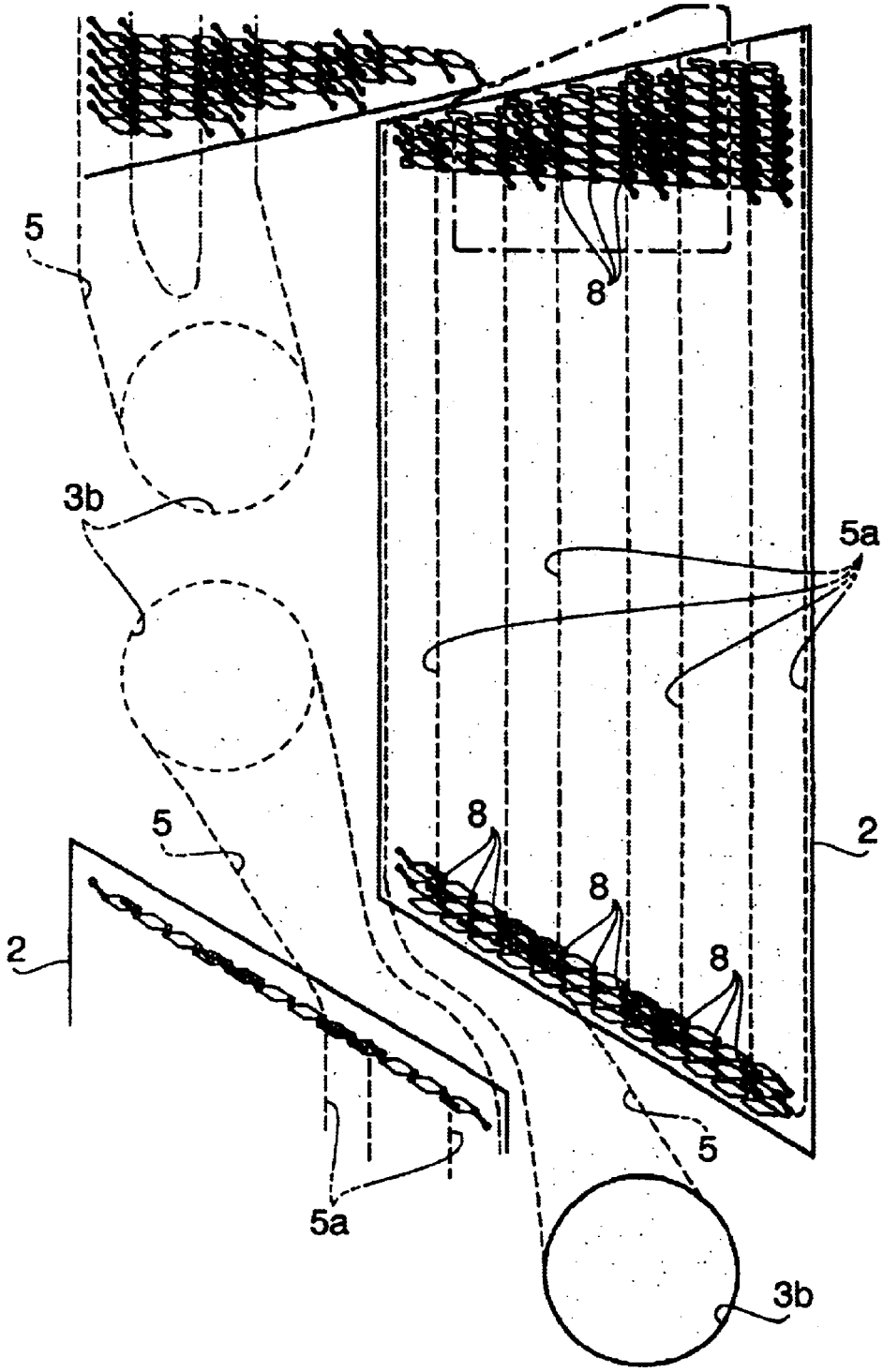
FIG. 2 is an enlarged view of an area surrounded by a dashed line in FIG. 1.
Figure 3:
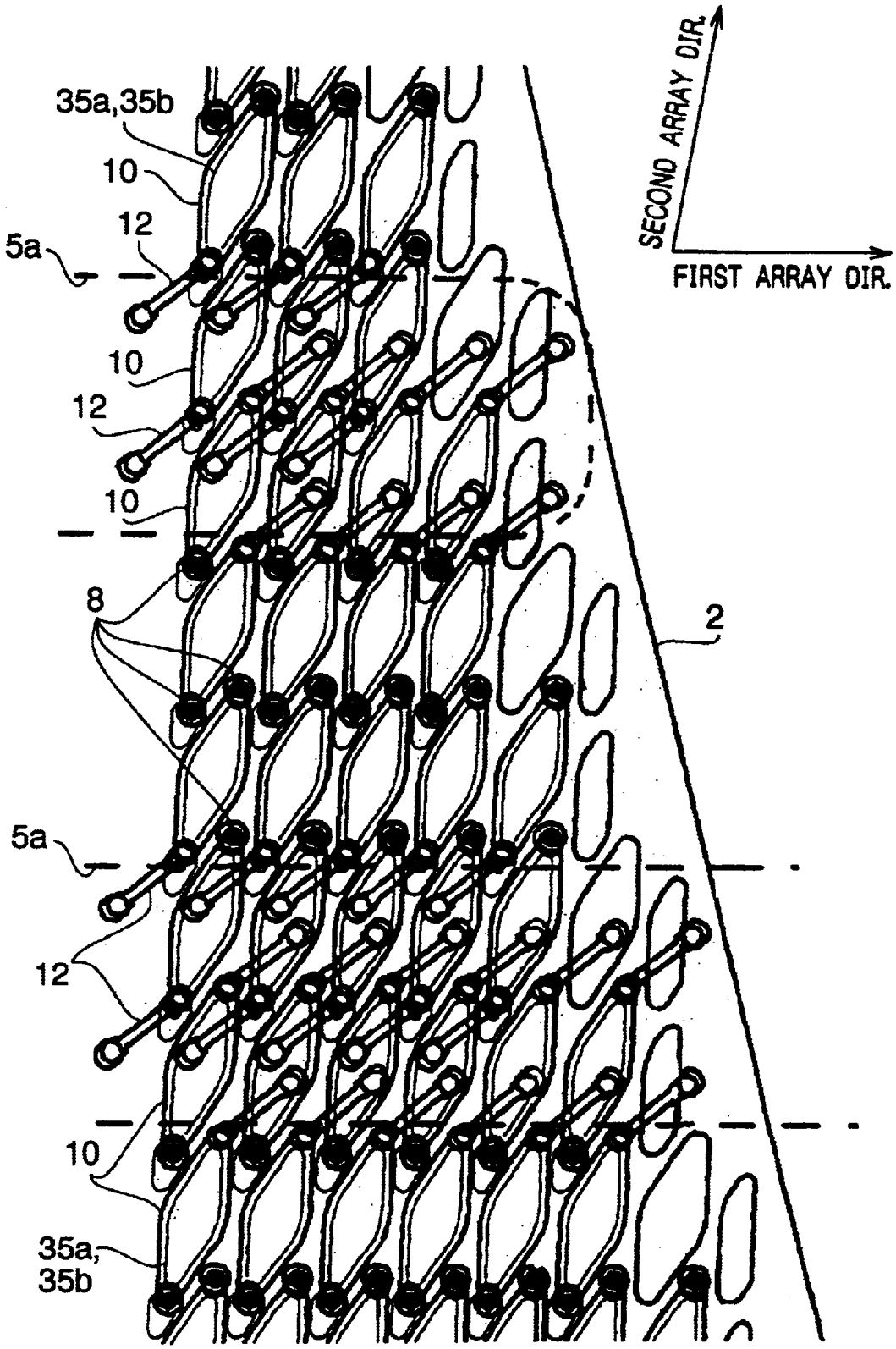
FIG. 3 is an enlarged view of an area surrounded by a dashed line in FIG. 2.
Figure 4:
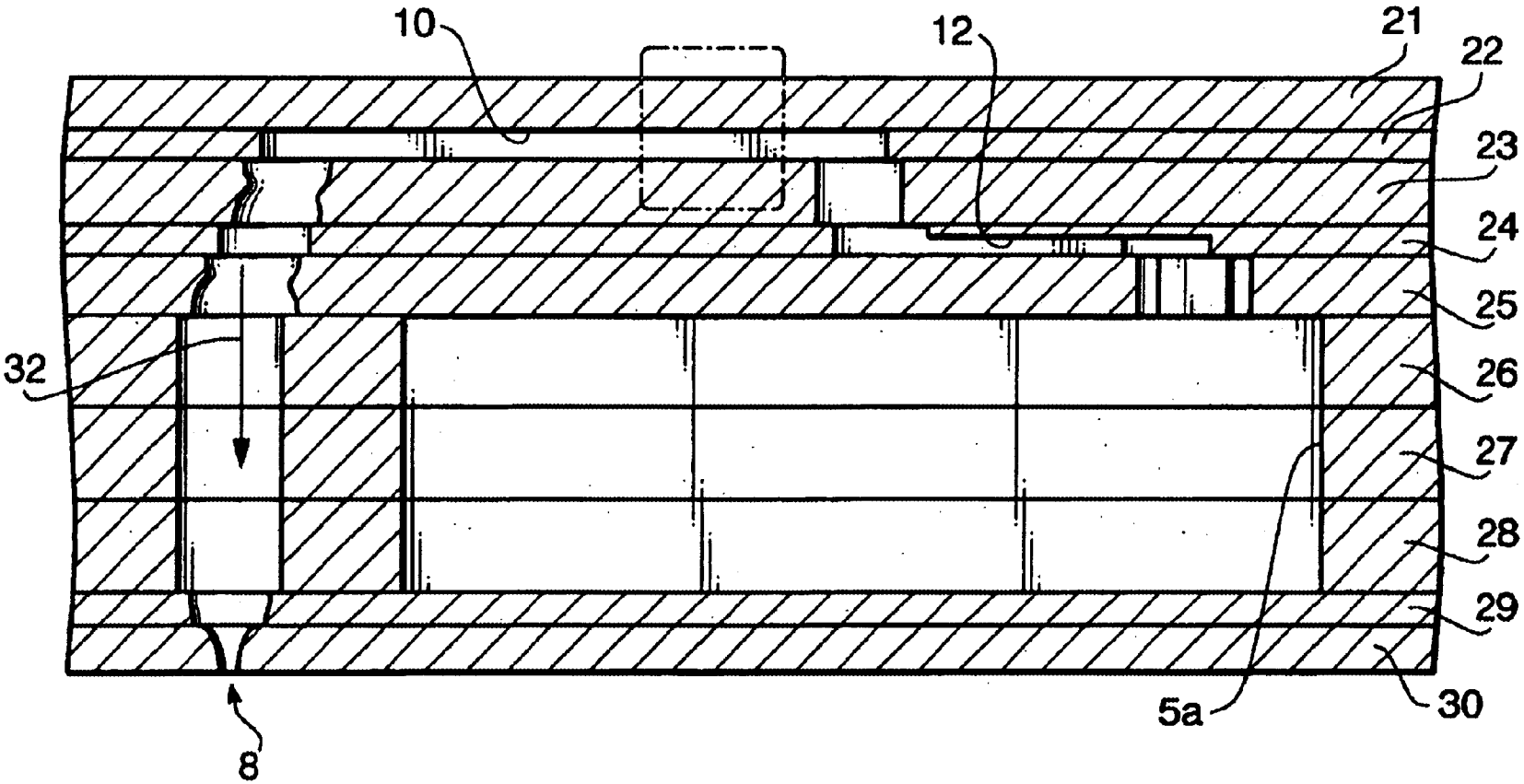
FIG. 4 is a sectional view of a primary part of the inkjet head shown in FIG. 1.
Figure 5:
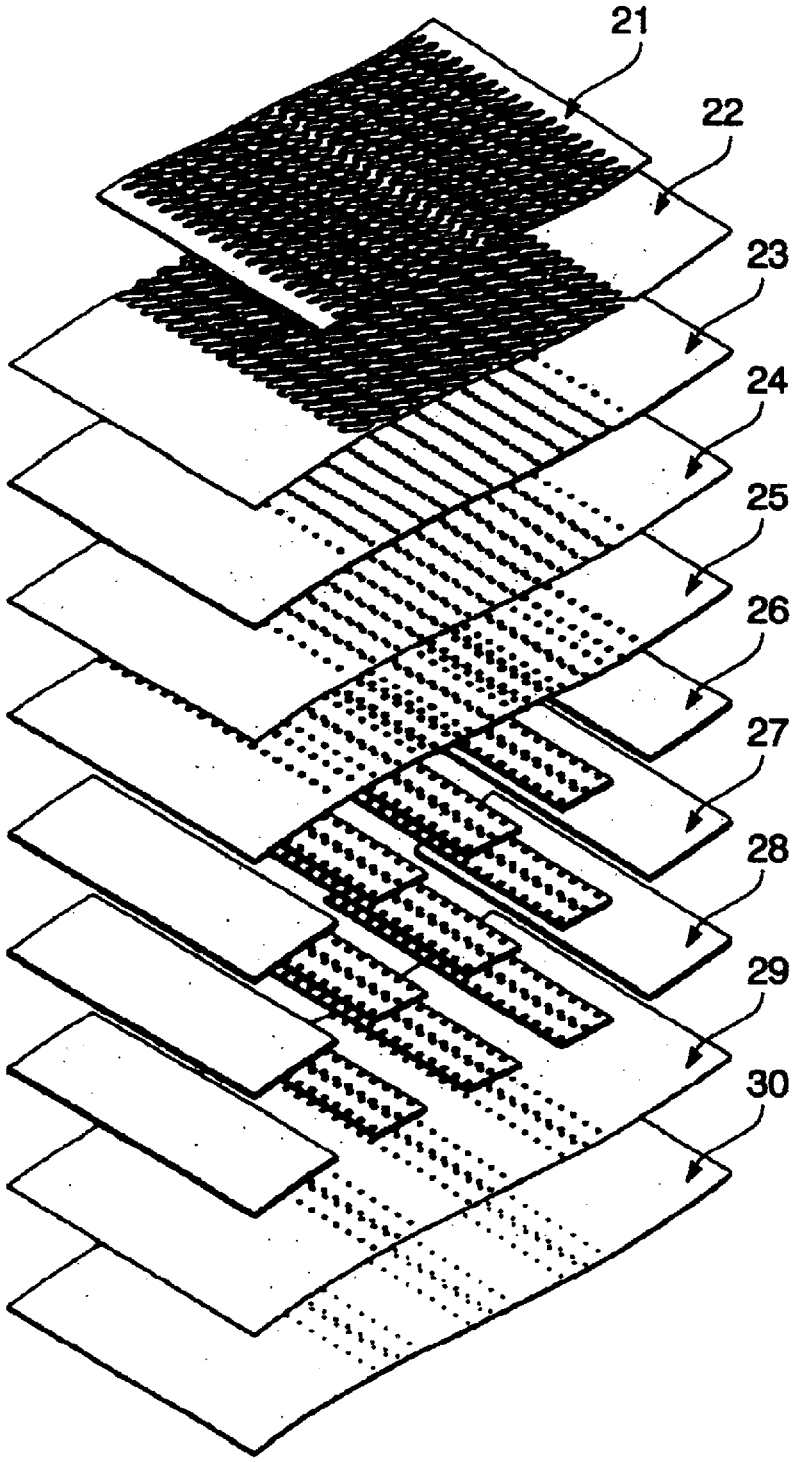
FIG. 5 is an exploded perspective view of the primary part of the inkjet head shown in FIG. 1.
Figure 6:
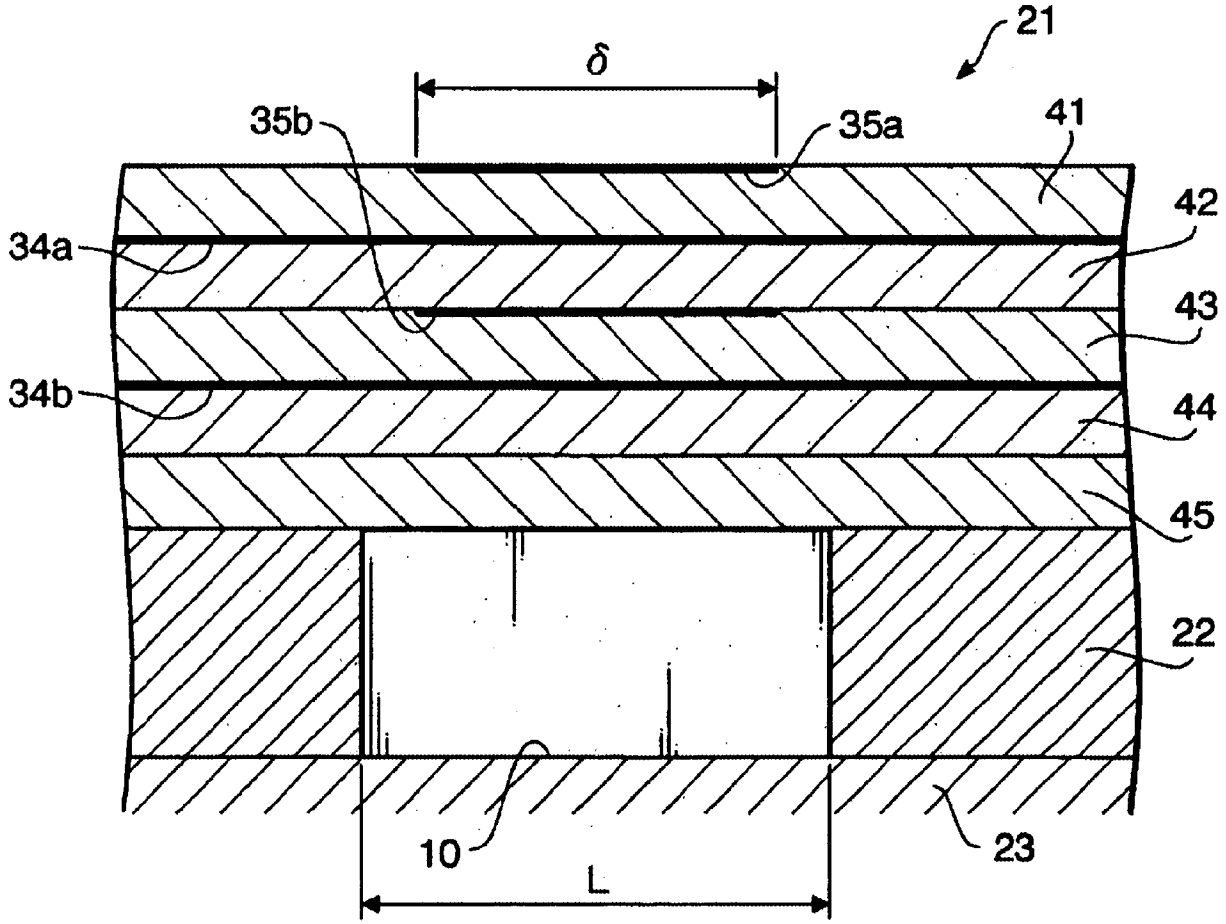
FIG. 6 is an enlarged side view of an area surrounded by a dashed line in FIG. 4.
Figure 8:
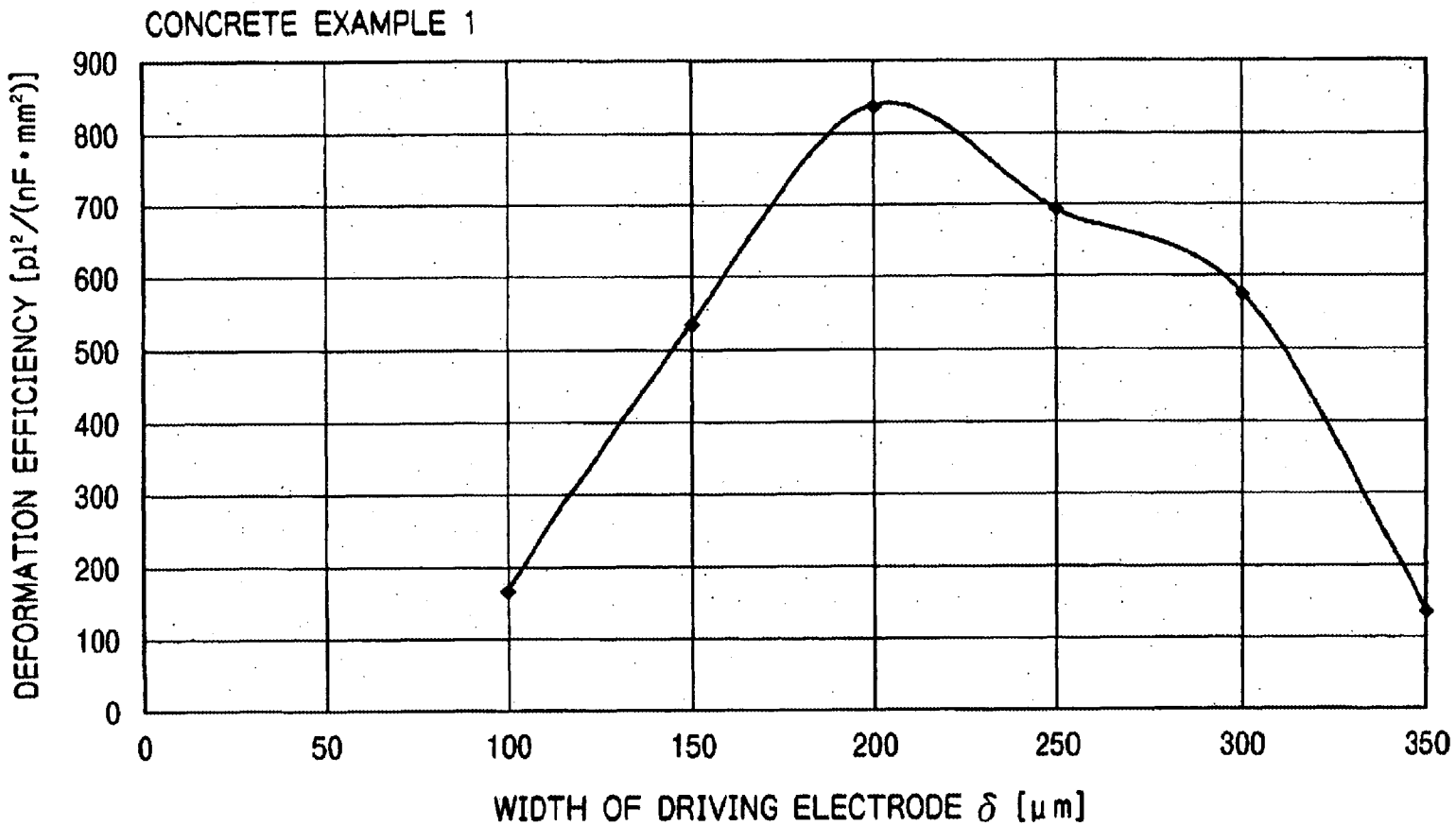
FIG. 8 is graph showing electrical efficiency and area efficiency of the inkjet head according to a first embodiment obtained by simulation.
Figure 9:
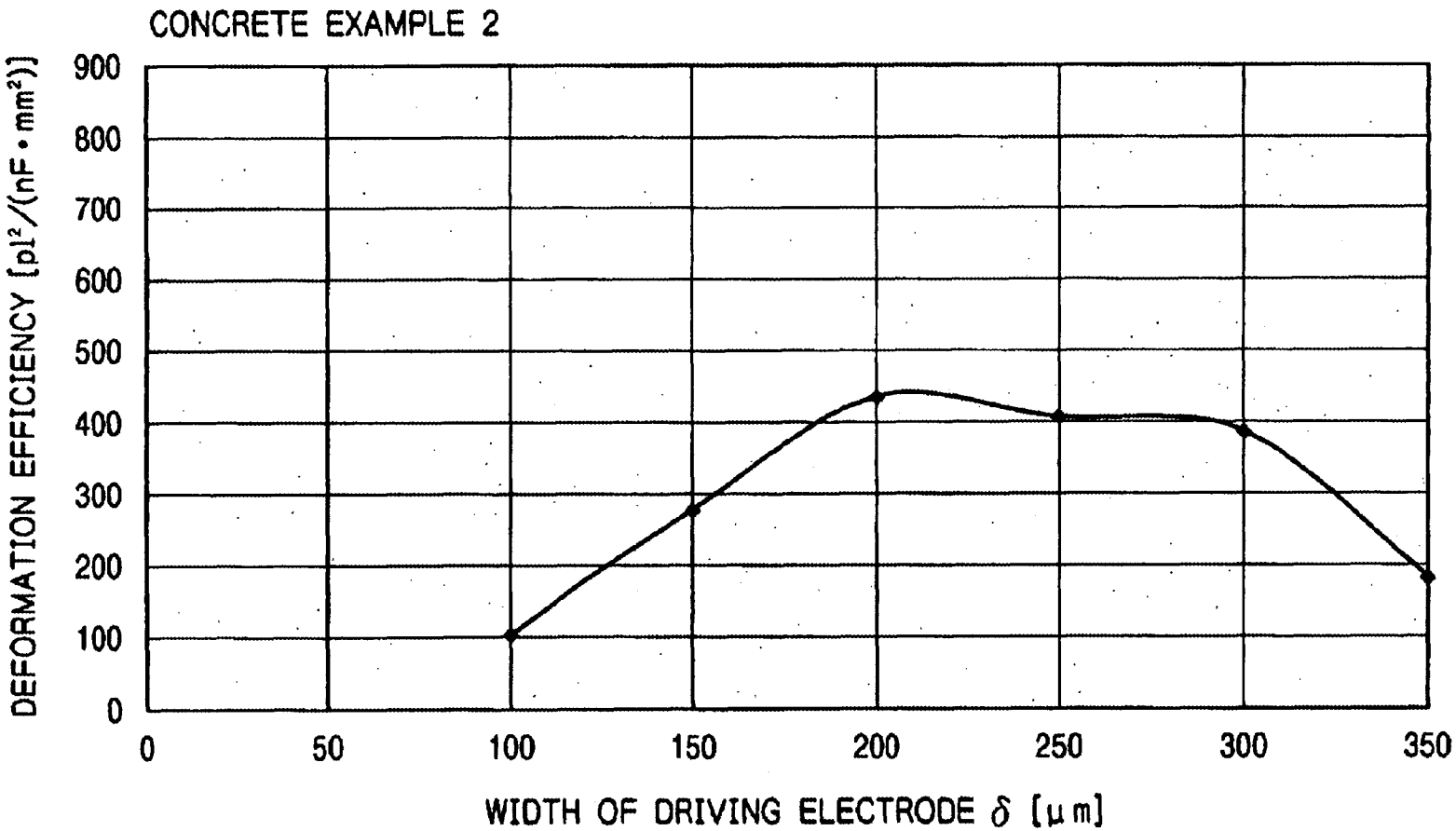
FIG. 9 is graph showing electrical efficiency and area efficiency of the inkjet head according to a second embodiment obtained by simulation.

FIG. 1 is a bottom view of an inkjet head 1 according to an embodiment of the invention. FIG. 2 is an enlarged view of an area encircled by a dashed line in FIG. 1. FIG. 3 is an enlarge view of an area surrounded by a dashed line in FIG. 2. FIG. 4 is a sectional view of a primary part of the inkjet head 1 shown in FIG. 1. FIG. 5 is an exploded perspective view of the main part of the inkjet head shown in FIG. 1. FIG. 6 is an enlarged side view of an area surrounded by a dashed line in FIG. 4.

An inkjet head 1 is employed in an inkjet printing apparatus, which records an image on a recording sheet by ejecting inks in accordance with an image data.

As shown in FIG. 1, the inkjet head 1 has, when viewed from the bottom, a substantially rectangular shape elongated in one direction (which is a main scanning direction of the inkjet printing apparatus). The bottom surface of the inkjet head 1 is defined with a plurality of trapezoidal ink ejecting areas 2 which are aligned in two lines extending in the longitudinal direction (i.e., the main scanning direction) of the inkjet head 1, and are also staggering (i.e., alternately arranged on the two lines).

On a surface of each ink ejecting area 2, a plurality of ink discharging openings 8 (see FIGS. 2 and 3) are arranged. An ink reservoir 3 is defined inside the inkjet head 1 along the longitudinal direction thereof. The ink reservoir 3 is in communication with an ink tank (not shown) through an opening 3*a*, which is provided at one end of the ink reservoir 3, thereby the ink reservoir 3 being filled with ink all the time.

A plurality of pairs of openings 3*b* and 3*b* are provided to the ink reservoir 3 along the elongated direction thereof (i.e., the main scanning direction), in a staggered arrangement. Each pair of openings 3*b* and 3*b* are formed in an area where the ink ejecting areas 2 are not defined when viewed from the bottom.

As shown in FIGS. 2 and 3, the ink reservoir 3 is in communication with an underlying manifold 5 through the openings 3*b*. Optionally, the openings 3*b* may be provided with a filter for removing dust in the ink passing therethrough. The end of the manifold 5 branches to define two sub-manifolds 5*a* and 5*a* (see FIG. 2). The two sub-manifolds 5*a* and 5*a* extend into the upper part of the ink ejecting area 2 from each of the two openings 3*b* and 3*b* which are located besides respective ends of each ink ejecting area 2 in the longitudinal direction of the inkjet head 1. Thus, in the upper part of one ink ejecting area 2, a total of four sub-manifolds 5*a* extend along the longitudinal direction of the inkjet head 1. Each of the sub-manifolds 5*a* is filled with ink supplied from the ink reservoir 3.

As shown in FIGS. 2 and 3, a plurality of (a number of) ink discharging openings 8 are arranged on the surface of each ink ejecting area 2. As shown in FIG. 4, each of the ink ejecting openings 8 is formed as a nozzle having a tapered end, and is in communication with the sub-manifold 5*a* through an aperture 12 and a pressure chamber (cavity) 10. The pressure chamber 10 has a rhombic shape viewed from the top, lengths of longer and shorter diagonals of which are, for example, 900 μm and 350 μm, respectively. An ink channel 32 is formed to extend, in the inkjet head 1, from the ink tank to the ink ejecting opening 8 through the ink reservoir 3, the manifold 5, the sub-manifold 5*a*, the aperture 12 and the pressure chamber 10. It should be noted that, in FIGS. 2 and 3, the pressure chambers 10 and the apertures 12 are drawn in solid lines for the purpose of clarity although they are formed beneath the ink ejecting area 2 and therefore should normally be drawn by broken lines.

Further, as can be seen in FIG. 3, the pressure chambers 10 are arranged close to each other within the ink ejecting area 2 so that an aperture 12, which is in communication with one pressure chamber 10 overlaps the adjacent pressure chamber 10 when viewed from the bottom. Such an arrangement can be realized since the pressure chambers 10 and the apertures 12 are formed at different levels (heights), as shown in FIG. 4. The pressure chambers 10 can be arranged dense so that high resolution images can be formed with the inkjet head 1 occupying an relatively small area in the printing apparatus.

The pressure chambers 10 are arranged within the ink ejecting areas 2, which are within the plane shown in FIG. 2, along two directions, i.e., the longitudinal direction of the inkjet head 1 (first array direction) and a direction slightly inclined with respect to a width direction of the inkjet head 1 (second array direction). The ink ejecting opening 8 is arranged with a density of 50 dpi in the first array direction. The pressure chambers 10 are arranged such that, in the second array direction, there are twelve pressure chambers 10, at maximum. It should be noted that a relative displacement, in the first array direction, between a pressure chamber 10 located at one end of the second array and another pressure chamber 10 at the other end of the second array corresponds to a size of the pressure chamber 10 in the first array direction. Thus, in a range defined between two ink ejecting openings 8 adjacently arranged in the first array direction, twelve ink ejecting openings 8 exist although they are different in positions in the width direction of the inkjet head 1. It should be noted that, in arrays on the end portions in the first direction, the number of the pressure chambers 10 is less than twelve due to oblique sides of the trapezoidal shape. However, the end portions of the adjoining ejecting area 2 (the arrays thereof opposing the arrays having less than twelve pressure chambers 10) is configured to compensate for each other, and thus, as the inkjet head 1 as a whole, the above condition is satisfied.

Thus, the inkjet head 1 according to the embodiment is capable of performing printing with a resolution of 600 dpi in the main scanning direction by sequentially ejecting ink from the plurality of ink ejecting openings 8 arranged in the second direction in accordance with the movement of the recording sheet.

Next, the sectional configuration of the inkjet head 1 will be described. As shown in FIGS. 4 and 5, the main part at the bottom side of the inkjet head 1 has a laminated structure in which a total of ten sheet members are laminated. The ten sheet members include an actuator unit 21, a cavity plate 22, a base plate 23, an aperture plate 24, a supplier plate 25, manifold plates 26, 27, 28, a cover plate 29, and a nozzle plate 30, in this order from the top.

The actuator unit 21 is configured, as will be described later in more detail, such that five piezoelectric sheets are laminated. Electrodes are provided to the actuator unit 21 so that three of the sheets are active and the other two are inactive.

The cavity plate 22 is a metal plate provided with a plurality of openings of generally rhombus shape to form the pressure chambers 10.

The base plate 23 is a metal plate including, for each pressure chamber 10 of the cavity plate 22, a communication hole for connecting the pressure chamber 10 and the aperture 12 and a communication hole extending from the pressure chamber 10 toward the ink ejecting opening 8.

The aperture plate 24 is a metal plate including, in addition to the apertures 12, a communication hole extending from the pressure chamber 10 to the ink ejecting opening 8 for each pressure chamber 10 of the cavity plate 22.

The supplying plate 25 is a metal plate including, for each pressure chamber 10 of the cavity plate 22, a communication hole for connecting the aperture 12 and the sub-manifold 5*a* and a communication hole extending from the pressure chamber 10 toward the ink ejecting opening 8.

The manifold plates 26, 27 and 28 are metal plates including, in addition to the sub-manifold 5*a*, a communication hole extending from the pressure chamber 10 toward the ink ejecting opening 8 for each pressure chamber 10 of the cavity plate 22.

The cover plate 29 is a metal plate including, for each pressure chamber 10 of the cavity plate 22, a communication hole extending from the pressure chamber 10 to the ink ejecting opening 8.

The nozzle plate 30 is a metal plate having, for each pressure chamber 10 of the cavity plate, one tapered ink ejecting opening 8 which serves as a nozzle.

The ten sheet members 21 through 30 are laminated after being aligned to form an ink channel 32 as shown in FIG. 4. This ink channel 32 extends upward from the sub-manifold 5*a*, and then horizontally at the aperture 12. The ink channel 32 then extends further upward, horizontally at the pressure chamber 10, and then obliquely downward for a certain length in a direction away from the aperture 12, and then vertically downward toward the ink ejecting opening 8.

As shown in FIG. 6, the actuator unit 21 includes five piezoelectric sheets 41, 42, 43, 44, 45, having substantially the same thickness of approximately 10 $\mu$m (or 15 $\mu$m). These piezoelectric sheets 41 through 45 are continuous planar layers. The actuator unit 21 is arranged to extend over a plurality of pressure chambers 10 which are within one of the ink ejecting areas 2 of the inkjet head 1. Since the piezoelectric sheets 41 through 45 extend over a plurality of pressure chambers 10 as the continuous planar layers, the piezoelectric element has high mechanical rigidity and improves the speed of response regarding ink ejection of the inkjet head 1.

Between the uppermost piezoelectric sheet 41 and the piezoelectric sheet 42, a common electrode 34*a* having a thickness of about 2 $\mu$m and extending over the entire area of the sheets 41 and 42 is provided. Similar to the common electrode 34*a*, another common electrode 34*b*, having a thickness of about 2 $\mu$m, is also formed between the piezoelectric sheet 43, which is immediately below the piezoelectric sheet 42, and the piezoelectric sheet 44 immediately below the sheet 43.

Further, driving electrodes (individual electrode) 35*a* are formed for respective pressure chambers 10 on the top of the piezoelectric sheet 41 (see also FIG. 3). Each driving electrode 35*a* is 1 $\mu$m thick and the top view thereof has a shape substantially similar to that of the pressure chamber 10 (e.g., a rhombic shape whose longer diagonal is 850 $\mu$m long and shorter diagonal is 250 $\mu$m long). Each driving electrode 35*a* is arranged such that its projection in the layer stacking direction is included within the pressure chamber 10.

Further, driving electrodes 35*b*, each having a thickness of about 2 $\mu$m, are arranged between the piezoelectric sheet 42 and the piezoelectric sheet 43 in a similar manner to that of the driving electrodes 35*a*. However, no electrodes are provided between the piezoelectric sheet 44, which is immediately below the piezoelectric sheet 43, and the piezoelectric sheet 45 immediately below the sheet 44, and below the piezoelectric sheet 45.

The common electrodes 34*a*, 34*b* are grounded. Thus, each area of the common electrodes 34*a*, 34*b* corresponding to the pressure chamber 10 is kept at the ground potential. The driving electrodes 35*a* and 35*b* are connected to drivers (not shown) by separate lead wires (not shown), respectively, so that the potential of the driving electrodes can be controlled for each pressure chamber 10. Note that the corresponding driving electrodes 35*a*, 35*b* forming a pair (i.e., arranged in up and down direction) and corresponding to the same pressure chamber 10 may be connected to the driver by the same lead wire.

It should be also noted that the common electrodes 34*a*, 34*b* are not necessarily formed as one sheet extending over the whole area of the piezoelectric sheets, however, a plurality of common electrodes 34*a*, 34*b* may be formed such that the projection thereof in the layer stacked direction covers the whole area of the pressure chamber 10, or such that the projection thereof is included within the area of each pressure chamber 10. In such a case, however, it is required that the common electrodes are electrically connected with each other so that the areas thereof opposing the pressure chamber 10 are maintained at the same potential.

In the inkjet head 1 according to the embodiment, the direction of polarization of the piezoelectric sheets 41 through 45 coincides with the thickness direction thereof. The actuator unit 21 is formed to function as a so-called unimorph type actuator. Specifically, the actuator unit 21 is configured such that three piezoelectric sheets 41 through 43 on the upper part (the sheets distant from the pressure chamber 10) are active layers and the other two piezoelectric sheets 44 and 45 at the lower part (the part closer to the pressure chamber 10) are inactive layers. When the driving electrodes 35*a*, 35*b* are applied with a predetermined positive/negative potential, if the direction of electrical field coincides with the direction of polarization, the portions of the piezoelectric sheets 41 through 43 (i.e., the active layers) sandwiched between the electrodes contract in a direction perpendicular to the polarization direction. In the meantime, the piezoelectric sheets 44 and 45, which are not affected by the electric field, do not contract. Thus, the upper layer piezoelectric sheets 41 through 43 and the lower layer piezoelectric sheets 44 and 45 deform differently in the polarization direction, and the piezoelectric sheets 41 through 45 as a whole deform such that the inactive layer side becomes convex (unimorph deformation). Since, as shown in FIG. 6, the bottom surface of the piezoelectric sheets 41 through 45 are fixed on the top surface of partitions 22, which define the pressure chambers 10, the pressure chamber side surface of the piezoelectric sheets 41 through 45 become convex. Accordingly, the capacity of the pressure chamber 10 decreases, which increases the pressure of the ink and causes the ink to be ejected from the ink ejecting opening 8.

If, thereafter, the application of the driving voltage to the driving electrodes 35*a* and 35*b* is cut, the piezoelectric sheets 41 through 45 recover to the neutral shapes (i.e., a planar shape as shown in FIG. 6) and hence the capacity of the pressure chamber 10 recovers (i.e., increases) to the normal capacity, which results in suction of ink from the manifold 5.

Note that in an alternative driving method, the voltage is initially applied to the driving electrodes 35*a*, 35*b*, cut on each ejection requirement and re-applied at a predetermined timing after certain duration. In this case, the piezoelectric sheets 41 through 45 recover their normal shapes when the application of voltage is cut, and the volume of the pressure chamber 10 increases compared to the initial volume (i.e., in the condition where the voltage is applied) and hence ink is drawn from the manifold 5. Then, when the voltage is applied again, the piezoelectric sheets 41 through 45 deform such that the pressure chamber side thereof become convex to increase the ink pressure by reducing the volume of pressure chamber, and thus the ink is ejected.

If the direction of the electric field is opposite to the direction of polarization, the portions of the piezoelectric sheets 41 through 43, or active layers, that is sandwiched by the electrodes expand in a direction perpendicular to the polarization direction. Accordingly, in this case, the portions of the piezoelectric sheets 41 through 45 that are sandwiched by electrodes 34*a*, 34*b*, 35*a*, 35*b* bend by piezoelectric transversal effect so that the pressure chamber side surfaces become concave. Thus, when the voltage is applied to the electrodes 34*a*, 34*b*, 35*a* and 35*b*, the volume of the pressure chamber 10 increases and ink is drawn from the manifold 5. Then, if the application of the voltage to the driving electrodes 35*a*, 35*b* is stopped, the piezoelectric sheets 41 through 45 recover to their normal form, and hence the volume of the pressure chamber 10 recovers to its normal volume, thereby the ink being ejected from the nozzle.

In the inkjet head 1, the following condition:

$$0.29 \leqq \delta/L \leqq 1,$$

where L represents a width of the pressure chamber 10, and δ represents the length of the driving electrodes 35*a* and 35*b* in the same direction in which the length L is measured. It should be noted that the pressure chamber 10 has a shape defined by a longitudinal length and the width which is not longer than the longitudinal length. In particular, each pressure chamber 10 has the rhombic shape having longer and shorter diagonal, which are referred to as the length and width of the pressure chamber 10, or the rhombic shape.

With the above-described configuration, the electrical efficiency (change of the capacity of the pressure chamber 10 for unit electric capacity) or the area efficiency (change of the capacity of the pressure chamber 10 for unit projected area) is improved with respect to the aforementioned conventional structure (see TABLE 1 shown later). The improvements in electrical efficiency and area efficiency allow downsizing of the drivers for the electrodes 34*a*, 34*b*, 35*a* and 35*b*, which contributes to decrease the manufacturing cost thereof. Further, as the drivers for the electrodes 34*a*, 34*b*, 35*a*, 35*b* are downsized, the pressure chambers 10 can be made compact. Accordingly, even if the pressure chambers 10 are highly integrated, sufficient amount of ink can be ejected. Therefore, downsizing of the inkjet head 1 and high density of the printed dots can be achieved. This effect is particularly significant when the sum of the numbers of the active and inactive layers is four or more.

Figure 10:
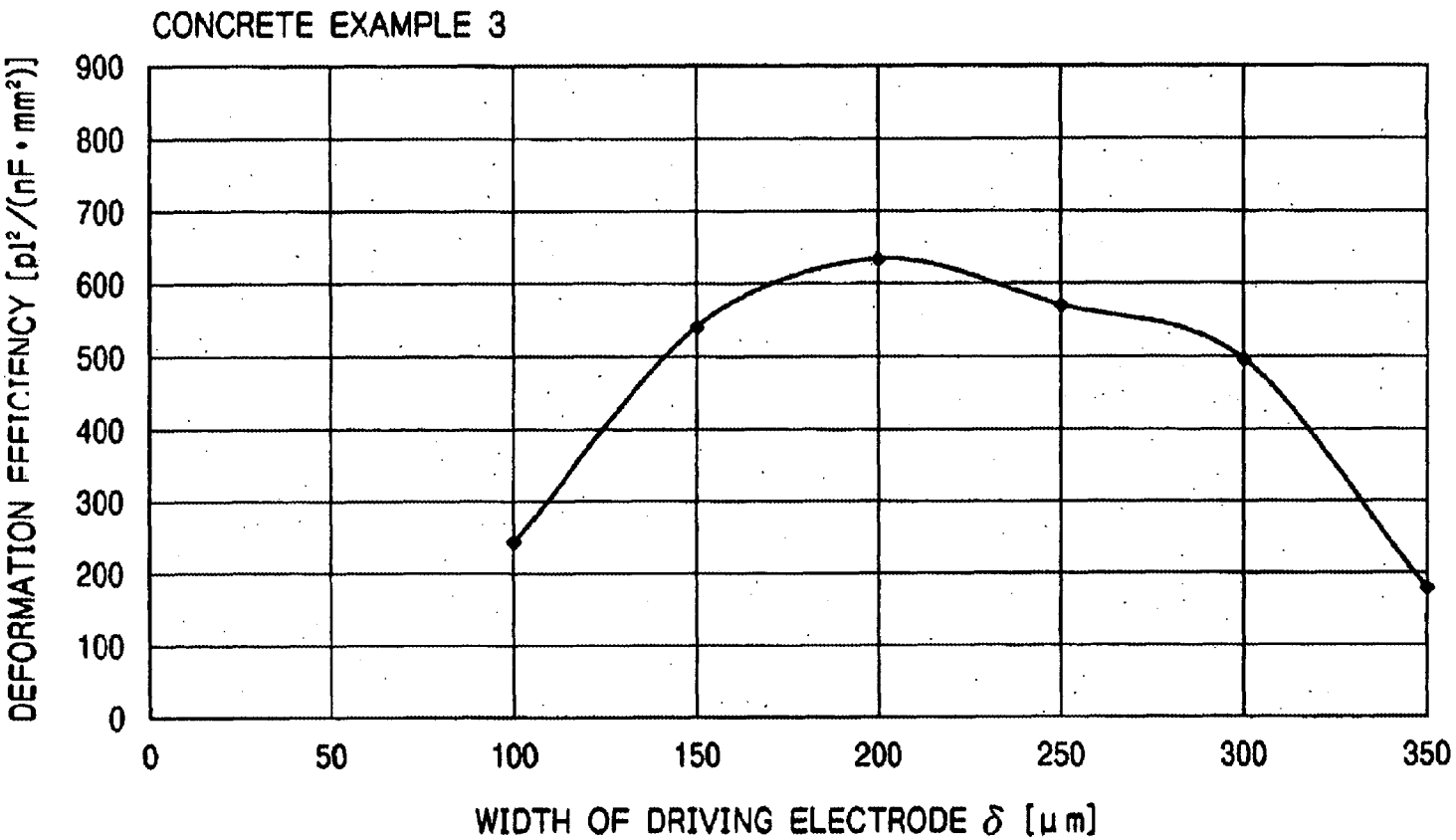
FIG. 10 is graph showing electrical efficiency and area efficiency of the inkjet head according to a third embodiment obtained by simulation.
Figure 11:
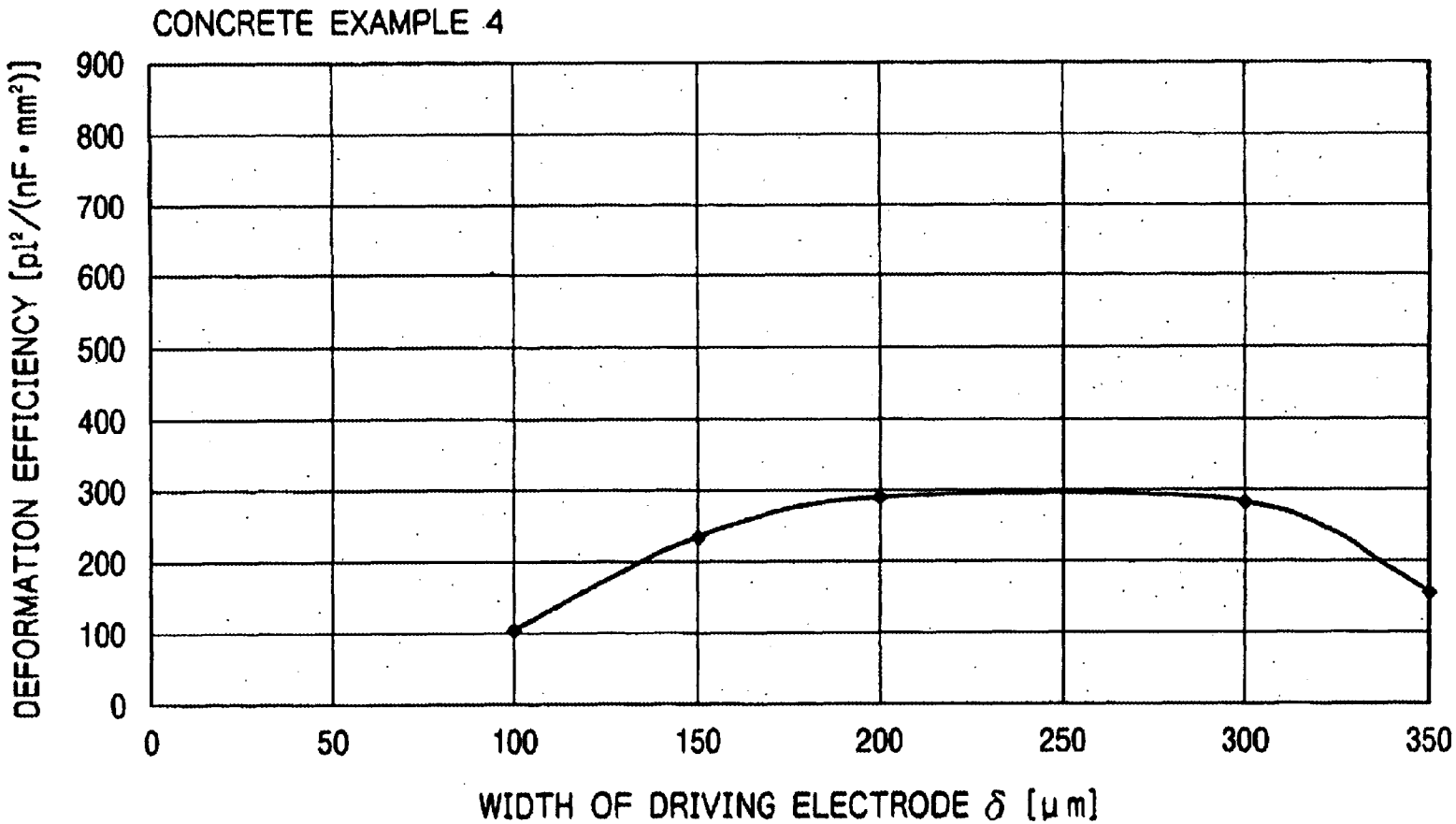
FIG. 11 is graph showing electrical efficiency and area efficiency of the inkjet head according to a fourth embodiment obtained by simulation.
Figure 12:
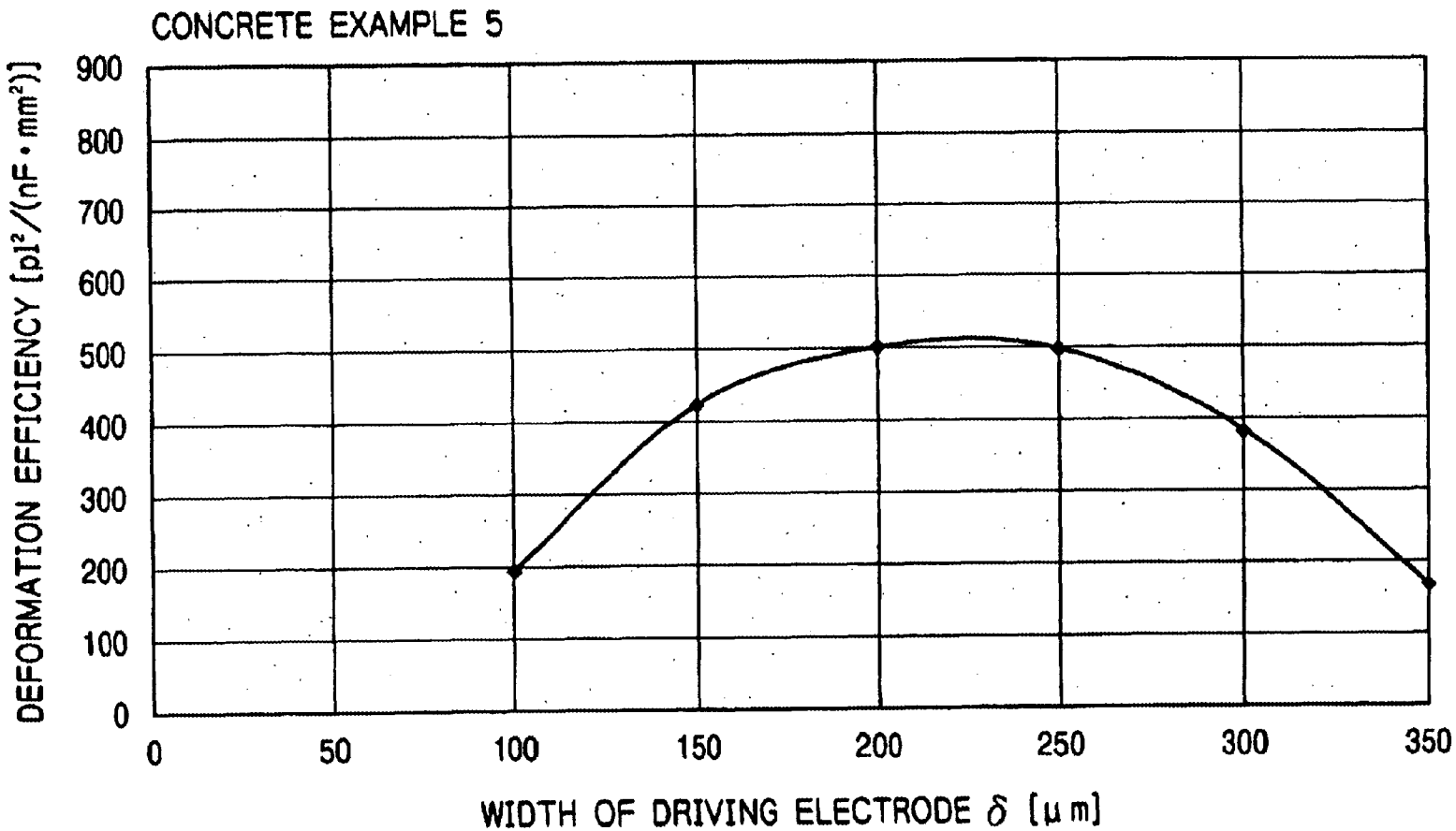
FIG. 12 is graph showing electrical efficiency and area efficiency of the inkjet head according to a fifth embodiment obtained by simulation.

As will be described later in more detail, from viewpoint of improving electrical efficiency and area efficiency, it is preferable that conditions $0.1\ \text{mm} \leqq L \leqq 1\ \text{mm}$ and $0.29 \leqq \delta/L \leqq 1$ are satisfied (see FIG. 13). , where L represents the length of the pressure chamber in the transverse direction and δ represents the length of the driving electrodes 35*a*, 35*b* in the direction the same as that of length L (see FIG. 10).

In the embodiment, the piezoelectric sheets 41 through 45 are made of Lead Zirconate Titanate (PZT) material which shows ferroelectricity. The electrodes 34*a*, 34*b*, 35*a* and 35*b* are made of metal of, for example, Ag—Pd family.

The preferred embodiment of the invention has been described in detail. It should be noted that the invention is not limited to the configuration of the above described exemplary embodiment, and various modifications are possible without departing from the gist of the invention.

For example, the materials of the piezoelectric sheets and the electrodes are not limited to those mentioned above, and can be replaced with other appropriate materials. Further, the planar shape, the sectional shape, and the arrangement of the pressure chambers may be modified appropriately. The numbers of the active and inactive layers may be changed under the condition that one of the numbers of the active layers and the inactive layers is two or more. Further, the active and the inactive layer may have different thicknesses.

CONCRETE EXAMPLES

Hereinafter, concrete examples of the inkjet heads according to the embodiment, and comparative examples will be described.

First Concrete Example

In the first concrete example, the inactive layers are located on the opposite side of the pressure chamber with respect to the active layers.

The electrical efficiency and area efficiency are obtained by simulation for an inkjet head which has a structure similar to the above-described structure except that there are two active layers and two inactive layers. The thickness of each of the active and inactive layers is 10 μm. In such a configuration, the width δ of the electrodes is changed from 50 μm to 350 μm at a step of 50 μm, and the electrical efficiency, area efficiency and deformation efficiency, which is a product of the electrical efficiency and the area efficiency, are calculated by simulation.

It is noted that the width δ is changed such that the widths of all the driving electrodes are maintained the same, and the shape of each driving electrode is maintained analogous (similar) with respect to the shape of the pressure chamber 10. Further, a central position of each driving electrode substantially coincides with the central position in the shorter width of the corresponding pressure chamber 10. The above applies to all the concrete examples described below.

Second Concrete Example

Using the inkjet head which is similar to the above-described inkjet head except that the thickness of each of the active and inactive layers is 15 μm, the width Δof the electrodes is changed from 50 μm to 350 μm at a step of 50 μm, and the electrical efficiency, area efficiency and deformation efficiency are calculated by simulation.

Third Concrete Example

Using the inkjet head which is similar to the above-described inkjet head except that two active layers and three inactive layers are provided and the thickness of each of the active and inactive layers is 10 μm, the electrical efficiency, area efficiency and deformation efficiency are calculated by simulation with the width δ of the electrodes is changed from 50 μm to 350 μm at a step of 50 μm.

Fourth Concrete Example

Using the inkjet head of the third concrete example except that the thickness of each of the active and inactive layers is 15 μm, the electrical efficiency, area efficiency and deformation efficiency are calculated by simulation with the width δ of the electrodes is changed from 50 μm to 350 μm at a step of 50 μm.

Fifth Concrete Example

Using the inkjet head which is similar to the above-described inkjet head except that two active layers and four inactive layers are provided and the thickness of each of the active and inactive layers is 10 μm, the electrical efficiency, area efficiency and deformation efficiency are calculated by simulation with the width δ of the electrodes is changed from 50 μm to 350 μm at a step of 50 μm.

Sixth Concrete Example

Using the inkjet head which is similar to the above-described inkjet head except that three active layers and three inactive layers are provided and the thickness of each of the active and inactive layers is 10 μm, the electrical efficiency, area efficiency and deformation efficiency are calculated by simulation with the width δ of the electrodes is changed from 50 μm to 350 μm at a step of 50 μm.

Comparative Example

Using the inkjet head which is similar to that disclosed in the above-described U.S. Pat. No. 5,402,159 (ten layers each having a thickness of 30 μm), the electrical efficiency, area efficiency and deformation efficiency are calculated by simulation with the width δ of the electrodes is changed from 50 μm to 350 μm at a step of 50 μm.

Results of Simulatin

The simulation results for the first through sixth concrete examples and the comparative example are indicated in FIG. 7. In FIGS. 8 through 13 are graphical representation showing a relationship between the width Δ(horizontal axis) and the deformation efficiency (vertical axis) for each of the first through sixth concrete examples.

As shown in FIGS. 8 through 13, in each concrete example, the deformation efficiency has its peak value for the width δ of 200 μm through 250 μm. Further, within a range of the width δ from 100 μm through 300 μm, each of the concrete examples 1 through 6 shows higher value in comparison with the value (72.886 $pl^2/(nF \cdot mm^2)$) of the comparative example.

In the second through sixth concrete examples, within a range of 100 μm including the width δ of 200 μm through 250 μm, the deformation efficiency include the peak value and changes relatively gently. Therefore, within this range, the excellent deformation efficiency is achieved. In other words, at a range of 100 μm through 150 μm, the curve of the graph rises at a relatively steep inclination, and at a range of 300 μm through 350 μm, it decreases at a relatively steep inclination. However, in the intermediate range (i.e., 150 μm through 300 μm), the curve shows a stable tendency, i.e., stays in a certain value range.

Next, the electrical efficiency, area efficiency and deformation efficiency are calculated by simulation with respect to the inkjet head which is similar to the above-described structure for the activation widths, i.e., the widths δ of 100 μm, 150 μm, 200 μm, 250 μm, 300 μm, and 350 μm. Table 13 shows the results. The total number of the active layers and inactive layers is in a range of three to six (four kinds), the thickness of the active layer or inactive layer is 10 μm, 15 μm and 20 μm (three kinds), and the number of the driving electrodes is in a range of one layer to three layers (at least a plurality of active layers or a plurality of inactive layers are included). The results include the results of the concrete examples 1 through 6.

Figure 13:
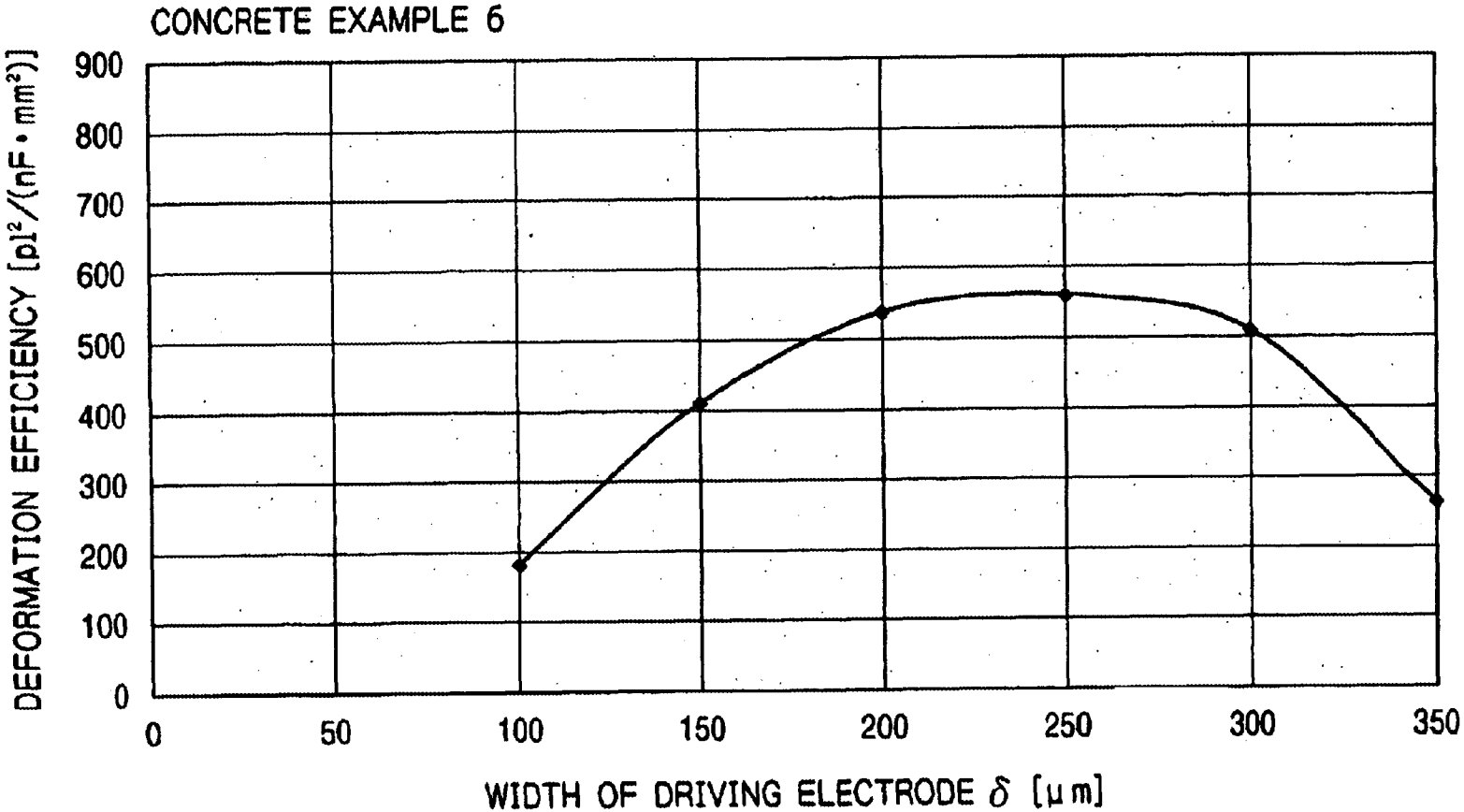
FIG. 13 is graph showing electrical efficiency and area efficiency of the inkjet head according to a sixth embodiment obtained by simulation.
Figure 14:
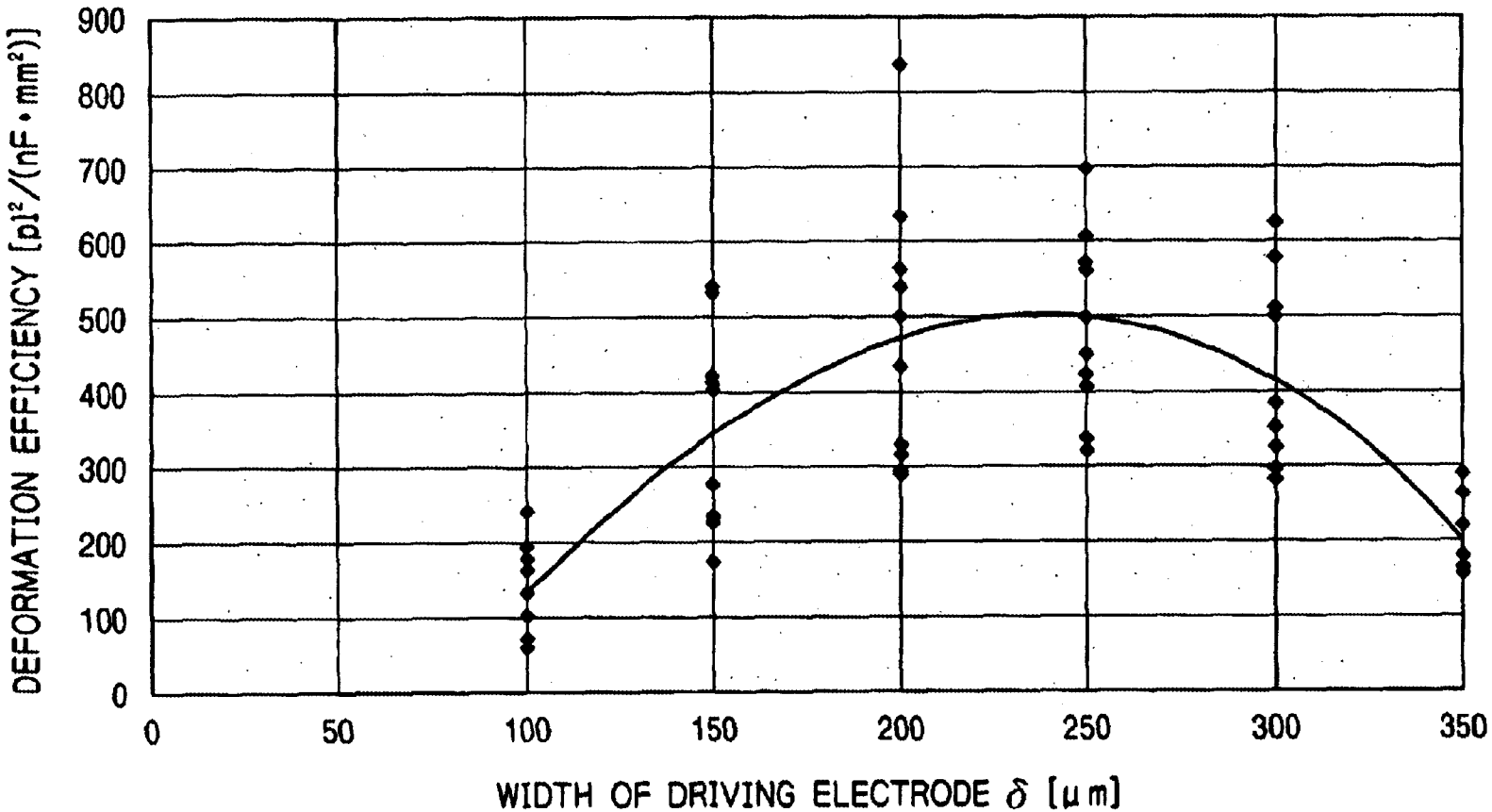
FIG. 14 is a graph showing deformation efficiencies of the inkjet heads obtained by simulation when the activation widths are 100 μm, 150 μm, 200 μm, 250 μm, 300 μm and 350 μm.

As can be appreciated from FIG. 13, the deformation efficiency is about 130 $pl^2/(nF \cdot mm^2)$ when the activation width is 100 μm, and increases as the activation width increases, up to the maximum value of about 500 $pl^2/(nF \cdot mm^2)$ when the width is 240 μm, and thereafter decreases to 350 μm as the activation width further increases.

The result above indicates that the deformation efficient is improved from that of the comparative example when the activation width is in the range of 100 μm (the ratio of the activation width to the pressure chamber width 350 μm is 100/350) to 350 μm (the ratio of the activation width to the pressure chamber width 350 μm is 350/350=1). From the viewpoint of obtaining further improved deformation efficiency, the activation width is preferably in the range of 140 μm (the above-mentioned ratio is 0.4) to 330 μm (the above-mentioned ratio is 0.94), more preferably in the range of 170 μm (the above-mentioned ratio is 0.49) to 300 μm (the above-mentioned ratio is 0.86), and most preferably in the range of 200 μm (the above-mentioned ratio is 0.57) to 270 μm (the above-mentioned ratio is 0.77).

In the above-described simulation, the width L of the pressure chamber 10 is fixed to 350 μm. However, as far as the condition 0.1 mm≦L is satisfied, the excellent deformation efficiency can be expected regardless of the width L of the pressure chamber.

It should be noted that the condition 0.1 mm≦L is derived from the reason below.

When the actuator unit is fabricated, it is necessary to reduce the individual differences of the capacities of the pressure chambers 10 due to the positioning errors of the driving electrodes with respect to the pressure chambers 10. For this purpose, it is necessary that the width δ is set smaller than the width L of the pressure chamber 10 with prospecting of a predetermined margin. However, if the width L is less than 0.1 mm, the width δ becomes too small and the effective change of the capacity of the pressure chamber may not be expected. Therefore, in accordance with a practical view point, condition 0.1 mm≦L is satisfied.

Preferably, condition 0.15 mm≦L≦0.8 mm may be satisfied. When this condition is satisfied, sufficient variation of the capacity of the pressure chamber is provided and the individual differences of the variation of the pressure chambers may be well suppressed.

The present disclosure relates to the subject matter contained in Japanese Patent Application No. 2001-365723, filed on Nov. 30, 2001, which is expressly incorporated herein by reference in its entirety.

What is claimed is:

1. An inkjet head, comprising:

a plurality of pressure chambers, each of which is configured such that an end thereof is connected to a discharging nozzle and the other end is connected to an ink supplier, each of said pressure chamber having a shape defined by a longitudinal length and a width which is not longer than the longitudinal length; and an actuator unit for said plurality of pressure chambers, wherein said actuator unit includes:

a plurality of planar piezoelectric layers covering over said plurality of pressure chambers;

a planar common electrode provided on one side surface of at least one of said plurality of planar piezoelectric layers; and a plurality of planar driving electrodes provided for said pressure chambers, respectively, said plurality of driving electrodes being formed on the other side of said at least one of said plurality of planar piezoelectric layers, wherein said plurality of planar piezoelectric layers include an active layer sandwiched between said common electrode and said plurality of driving electrodes, and an inactive layer which is not sandwiched by said common electrode and driving electrodes, wherein, when each of said plurality of driving electrodes is set to have a voltage different from the potential of said common electrode, a portion of said active layer corresponding to the driving electrode deforms in accordance with piezoelectric transverse effect, a unimorph effect being generated by the deformation of said active layer in association with the inactive layer to vary a capacity of each pressure chamber, and wherein conditions:

$$0.1\ \text{mm} \leqq L,$$

and $$0.29 \leqq \delta/L \leqq 1,$$

are satisfied, wherein L represents the width of a pressure chamber and δ represents a length of a driving electrode extending in parallel with the width L.

2. The inkjet head according to claim 1, wherein a central position of each of said driving electrodes substantially coincides with the central position of the width of each of said pressure chambers.

3. The inkjet head according to claim 1, wherein condition:

$$0.15\ \text{mm} \leqq L \leqq 0.8\ \text{mm}$$

is satisfied.

4. The inkjet head according to claim 1, wherein condition:

$$0.4 \leqq \delta/L \leqq 0.94$$

is satisfied.

5. The inkjet head according to claim 1, wherein condition:

$$0.49 \leqq \delta/L \leqq 0.86$$

is satisfied.

6. The inkjet head according to claim 1, wherein condition:

$$0.57 \leqq \delta/L \leqq 0.77$$

is satisfied.

7. The inkjet head according to claim 1, wherein a plan view shape of each of the driving electrodes is similar to a plan view shape of the pressure chamber on the piezoelectric layers.

8. The inkjet head according to claim 1, wherein each of said pressure chambers has a rhombic shape, and wherein said width is a length of a shorter diagonal of the rhombic shape.

9. The inkjet head according to claim 1, wherein said actuator unit includes at least a plurality of active layers or a plurality of inactive layers.

10. The inkjet head according to claim 1, wherein said plurality of planer piezoelectric layers include a plurality of stacked active layers and inactive layers, said active layers being localized toward one end of said actuator unit, the end being opposite to an end facing said pressure chambers.

11. The inkjet head according to claim 1, wherein said plurality of planar piezoelectric layers include plurality of stacked active layers and inactive layers, one of said active layers being a furthest layer from said pressure chambers of all said active layers and inactive layers.

12. The inkjet head according to claim 11, wherein one of said inactive layers is in a nearest layer from said pressure chambers of all said active layers and inactive layers.

13. An inkjet head, comprising:

a plurality of pressure chambers, each of which being configured such that an end thereof is connected to a discharging nozzle and the other end is connected to an ink supplier, each of said pressure chamber having a rhombic shape having a longer diagonal and a shorter diagonal; and an actuator unit for said plurality of pressure chambers, wherein said actuator unit includes:

a planar piezoelectric layer covering over said plurality of pressure chambers;

a planar common electrode provided on one side surface of said planar piezoelectric layer; and a plurality of planar driving electrodes provided for said pressure chambers, respectively, said plurality of driving electrodes being formed on the other side of said planar piezoelectric layer, and wherein conditions:

$$0.1\ \text{mm} \leqq L, \text{ and}$$

$$0.29 \leqq \delta/L \leqq 1,$$

are satisfied, wherein L represents a length of the shorter diagonal of each pressure chamber and δ represents a length of a driving electrode extending in parallel with the length L.

14. The inkjet head according to claim 13, wherein a plan view shape of each driving electrode is included within an area of a plan view shape of a pressure chamber on said actuator unit.

15. The inkjet head according to claim 13, further comprising a plurality of planar piezoelectric layers, wherein said plurality of planar piezoelectric layers include an active layer sandwiched between said common electrode and said plurality of driving electrodes, and an inactive layer which is not sandwiched by said common electrode and driving electrodes, wherein, when each of said plurality of driving electrodes is set to have a voltage different from the potential of said common electrode, a portion of said active layer corresponding to the driving electrode deforms in accordance with piezoelectric transverse effect, a unimorph effect being generated by the deformation of said active layer in association with the inactive layer to vary a capacity of each pressure chamber.

16. The inkjet head according to claim 13, wherein a central position of each of said driving electrodes substantially coincides with a central portion of the width of each of said pressure chambers.

17. The inkjet head according to claim 13, wherein condition:

$$0.15\ \text{mm} \leqq L \leqq 0.8\ \text{mm}$$

is satisfied.

18. The inkjet head according to claim 13, wherein condition:

$$0.4 \leqq \delta/L \leqq 0.94$$

is satisfied.

19. The inkjet head according to claim 13, wherein condition:

$$0.49 \leqq \delta/L \leqq 0.86$$

is satisfied.

20. The inkjet head according to claim 13, wherein condition:

$$0.57 \leqq \delta/L \leqq 0.77$$

is satisfied.

21. The inkjet head according to claim 13, wherein a plan view shape of each of the driving electrodes is similar to a plan view shape of the pressure chamber on the piezoelectric layers.

22. The inkjet head according to claim 13, wherein said actuator unit includes at least a plurality of active layers or a plurality of inactive layers.

* * * * *